US010753697B2

(12) United States Patent
Seibel

(10) Patent No.: US 10,753,697 B2
(45) Date of Patent: Aug. 25, 2020

(54) SELF EJECTING MAGAZINE COVER FOR USE WITH AMMUNITION MAGAZINES

(71) Applicant: Gibborim Tactical LLC, Edwardsville, KS (US)

(72) Inventor: Jacob Alexander Seibel, Edwardsville, KS (US)

(73) Assignee: Gibborim Tactical LLC, Edwardsville, KS (US)

( * ) Notice: Subject to any disclaimer, the term of this patent is extended or adjusted under 35 U.S.C. 154(b) by 0 days.

(21) Appl. No.: 16/154,172

(22) Filed: Oct. 8, 2018

(65) Prior Publication Data

US 2019/0107352 A1 Apr. 11, 2019

Related U.S. Application Data

(60) Provisional application No. 62/570,725, filed on Oct. 11, 2017, provisional application No. 62/637,624, filed on Mar. 2, 2018.

(51) Int. Cl.

| | |
|---|---|
| ***F41A 9/68*** | (2006.01) |
| ***F41A 9/63*** | (2006.01) |
| ***F41A 35/02*** | (2006.01) |
| ***F41A 17/38*** | (2006.01) |
| *F41A 9/59* | (2006.01) |

(52) U.S. Cl.

CPC ..... *F41A 17/38* (2013.01); *F41A 9/63* (2013.01); *F41A 9/68* (2013.01); *F41A 35/02* (2013.01); *F41A 9/59* (2013.01)

(58) Field of Classification Search

CPC ..... F41A 9/68; F41A 9/69; F41A 9/62; F41A 9/63; F41A 35/02

See application file for complete search history.

(56) References Cited

U.S. PATENT DOCUMENTS

| | | | | |
|---|---|---|---|---|
| 4,100,694 | A * | 7/1978 | Musgrave | F41A 17/38 42/106 |
| 4,442,962 | A | 4/1984 | Musgrave | |
| 4,484,404 | A | 11/1984 | Johnson | |
| 4,628,627 | A * | 12/1986 | Johnson | F41A 9/63 42/90 |
| 5,174,482 | A * | 12/1992 | Rogers | F42B 39/02 221/185 |
| 6,698,129 | B1 * | 3/2004 | Hanks | F41A 9/63 42/90 |

(Continued)

*Primary Examiner* — Gabriel J. Klein

(74) *Attorney, Agent, or Firm* — Husch Blackwell LLP

(57) ABSTRACT

A cover for an ammunition magazine is provided. The cover can include a top wall and a plurality of side walls extending downward from the top wall. The side walls can define a lower perimeter edge and an interior cavity configured for receiving an open end of an ammunition magazine for a firearm. The cover can include a bracket mounting wing extending outward from one of the side walls and a bracket connected to the bracket mounting wing. The bracket can include a vertical portion and a horizontal portion. The cover can used with a set of coupled magazines used with a firearm by placing the cover over an open end of a spare magazine when a primary magazine is inserted into the firearm. The cover can be automatically detach from the spare magazine when the primary magazine is removed from the firearm due to the bracket contacting the firearm.

20 Claims, 8 Drawing Sheets

(56) References Cited

U.S. PATENT DOCUMENTS

| | | | | |
|---|---|---|---|---|
| 7,073,285 | B2 * | 7/2006 | Obong | F42B 39/02<br>224/931 |
| 7,497,043 | B2 * | 3/2009 | Clifton, Jr. | F41A 9/63<br>224/239 |
| 7,562,482 | B1 | 7/2009 | Johnson | |
| D704,293 | S * | 5/2014 | Mullen | D22/108 |
| 2011/0107645 | A1 * | 5/2011 | Faifer | F41A 9/63<br>42/90 |

* cited by examiner

SELF EJECTING MAGAZINE COVER FOR USE WITH AMMUNITION MAGAZINES

CROSS-REFERENCE TO RELATED APPLICATIONS

This Application claims priority to U.S. Provisional Patent Application Ser. No. 62/570,725, filed on Oct. 11, 2017, to Jacob Alexander Seibel, entitled "Self ejecting magazine cover for use with coupled ammunition magazines,", the entire disclosure of which is incorporated herein by reference, and U.S. Provisional Patent Application Ser. No. 62/637,624, filed on Mar. 2, 2018, to Jacob Alexander Seibel, entitled "Self ejecting magazine cover for use with ammunition magazines,", the entire disclosure of which is incorporated herein by reference.

FIELD OF THE INVENTION

The present invention is directed generally to ammunition magazines for firearms, and in particular, to devices for covering ammunition magazines during use and/or storage.

BACKGROUND OF THE INVENTION

Many common firearms are supplied ammunition via a box magazine. The magazine can be detached once the cartridges are expended and a new magazine can be inserted into the firearm providing more ammunition. It is advantageous for police officers, military personnel, competitive shooters, and other civilians engaged in shooting sports to have a readily available supply of ammunition. Typically spare magazines are carried on a user's clothing or belt. It can take extra time, however, to remove a magazine from its position on a belt or clothing. In order to increase the efficiency of switching magazines, several devices have been made that attach a spare magazine to a firearm.

In addition, it is common practice to link two magazines together and several devices have been made that couple or link two or more ammunition magazines together. Typically, when two magazines are coupled together, the first magazine is inserted into the firearm while the second is attached vertically to the first magazine by an apparatus. This reduces the time of a reload and makes a spare magazine very accessible. However, the coupling of two magazines, and the devices thereto, can result in several operational problems. First, the open end of the spare (second) magazine is left exposed to the elements. This can lead to debris getting into the magazine and causing a malfunction. Second, the first cartridge of the spare magazine has a tendency to slide forward while the first magazine is being fired or during transport. This results in the first cartridge protruding from the front of the spare magazine. The cartridge can then get caught on the magazine well during a reload and cause a malfunction.

There have been several unsuccessful attempts to address the aforementioned issues. In U.S. Pat. No. 4,442,962, entitled "Magazine Hanger," a magazine hanger is described for carrying a spare magazine. According to the '962 patent, a magazine is inserted into the hanger and the hanger is then attached to an object via two loops on top of the hanger. If the hanger were to be used on a coupled magazine it would remain attached to the firearm even after the magazine was removed. This has the possibility to interfere with weapons manipulation by obstructing important firearm features such as, but not limited to, a bolt catch. The hanger also relies on a pendulum that fits under a magazine feed lip. This has the effect of compressing the cartridges in a magazine and would require one or more cartridges to be removed from the magazine to make the hanger work. In addition, in order to release the magazine a latch must be disengaged by finger pressure to a tab on the hanger, thus adding time to the reload process of the firearm.

In U.S. Pat. No. 4,484,404, entitled "Spare Magazine Holder," a protective carrier for a spare magazine is described. The '404 patent describes a covering that is attached to the left side of a fire arm. A loaded spare magazine is inserted into the cover and it is held in place by a latch mechanism. When the magazine release button is pushed, the latch mechanism is activated and the empty magazine will drop from the firearm. The spare magazine will drop from the cover at the same time, which prohibits the user from selectively ejecting a certain magazine for clearing a malfunction. The cover also obstructs the use of a bolt catch on certain types of rifles and other firearms. This means the user will have to use the charging handle to chamber a cartridge once the reload is completed, which takes more time than simply striking the bolt catch to chamber a cartridge. In addition, the cover described in the '404 patent would be expensive to the user due to material and manufacturing costs.

In U.S. Pat. No. 7,562,482, entitled "Spare Magazine Cover with Independent Latch Mechanism," a cover is described for carrying a spare ammunition magazine. The cover is attached to the left side of a firearm. The spare magazine is inserted into the cover and held in place by an independent latch mechanism. The magazine can be released by applying pressure to a lever on the carrier. However, the design and configuration of the cover described in the '482 patent requires additional time during a reload and would be expensive to the user due to material and manufacturing costs.

In U.S. Pat. No. 7,497,043, entitled "Magazine Doubler," a magazine doubling device is described that contains a body holding two magazines. The device includes an attached blocking element that goes in the magazine not in use. It is placed on the top of the loaded cartridges in the place of the top cartridge. However, this reduces magazine capacity and the blocking element must be manually removed before inserting the magazine into a firearm. In addition, the blocking element will remain attached via a rubber band allowing it to swing freely and interfere with weapons manipulations.

Accordingly, a need exists for a device that can allow for the efficient and effective use of linked or coupled ammunitions magazines with firearms without the aforementioned drawbacks and problems.

SUMMARY OF THE INVENTION

The present invention is directed to a cover for an ammunition magazine to protect the open end of the ammunition magazine during use and/or storage. According to one embodiment, the cover can be configured for use on a spare magazine that is coupled to a primary magazine during use with a firearm. According to one embodiment, the cover can be configured to automatically detach and eject away from the spare magazine when the primary magazine is removed from the firearm during a reload maneuver.

According to one embodiment, the cover can include main body portion comprising a top wall and a perimeter sidewall extending downward from the top wall and terminating at a lower perimeter edge. The perimeter sidewall can include a plurality of side walls, including a front wall, rear wall, first side wall and second side wall. The perimeter sidewall can define a cover cavity configured for receiving an upper open end of an ammunition magazine. The perimeter sidewall can create a cavity opening at its lower perimeter edge that provides access to the cover cavity from the lower end of the cover.

According to one embodiment, the cover can include a feed lip edge located on the lower perimeter edge of one of the walls forming the perimeter sidewall. According to one embodiment, the feed lip edge can form an angled and narrowing edge extending downward beyond the remainder of lower perimeter edge. According to another embodiment, the feed lip edge can form an angled and narrowing edge defined into one of the walls forming the perimeter sidewall along the lower perimeter edge and terminate in alignment with lower perimeter edge.

According to one embodiment, the cover can include a bracket portion comprising a bracket mounting wing that extends outward from on the walls of the perimeter sidewall and a bracket connected to the bracket mounting wing. The bracket can be configured with an L-type shape and include a lower vertical portion and an upper horizontal portion. The lower vertical portion can be generally aligned with the plane of the bracket mounting wing and the upper horizontal portion can extend perpendicularly away from the vertical portion. The bracket and the bracket mounting wing can be connected together by any suitable means, including a fastener, and can also be integrally or removably connected.

According to one embodiment, the cover can be used in connection with two ammunition magazines that are coupled together. When the primary magazine is inserted into a firearm, the coupled spare magazine is positioned to the side of primary magazine and to the side of the firearm. Because the spare magazine is not in use, its open upper end is exposed to potential damage and debris. The cover can be inserted over the open end of the spare magazine for protection by inserting the upper open end into the cover cavity. The cover can be frictionally retained on the spare magazine by the perimeter sidewall of the cover. When the cover is placed on the spare magazine, the bracket, and particularly the horizontal portion of the bracket, extends over and above the upper receiving portion of the firearm. Then, when the user of the firearm elects to reload and change to the spare ammunition magazine, the primary magazine is removed from the firearm by pulling the magazine downward. Because the two magazines are connected together, the spare magazine also travels in the downward direction which causes the horizontal portion of the bracket to contact the upper receiving portion of the firearm. This restricts the cover from traveling downward along with the spare magazine, which causes the cover to detach and eject from the upper open end of spare magazine. As the cover falls to the ground, the user can freely insert the spare magazine into the firearm without having to take any additional actions to remove the cover from the spare magazine.

Other aspects and advantages of the present invention will be apparent from the following detailed description of the preferred embodiments of the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
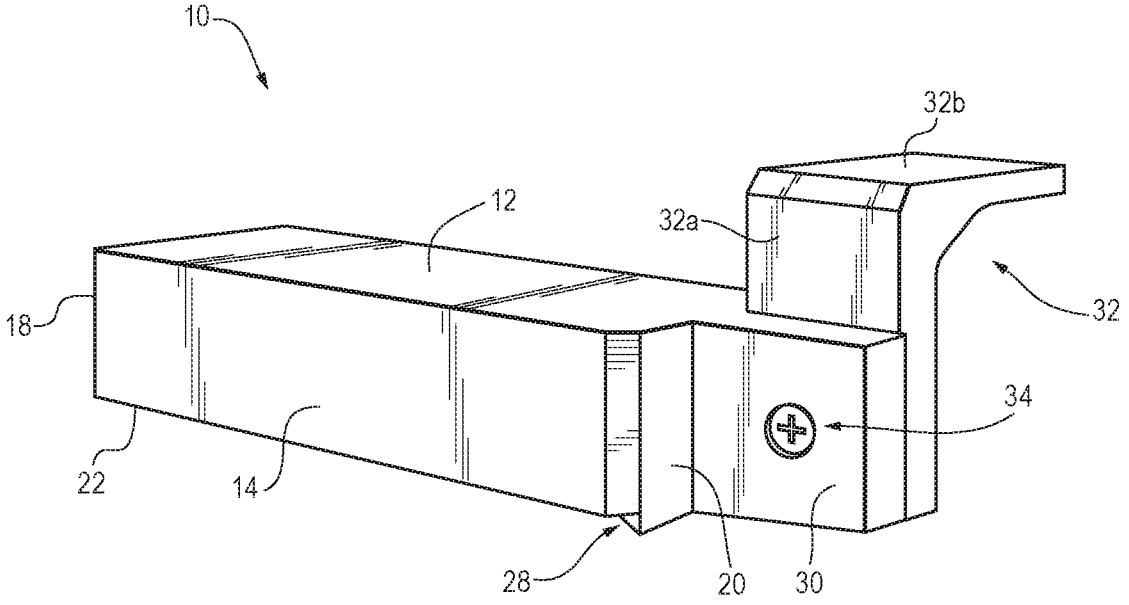
FIG. 1 is a perspective view of a cover for an ammunition magazine in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 7:
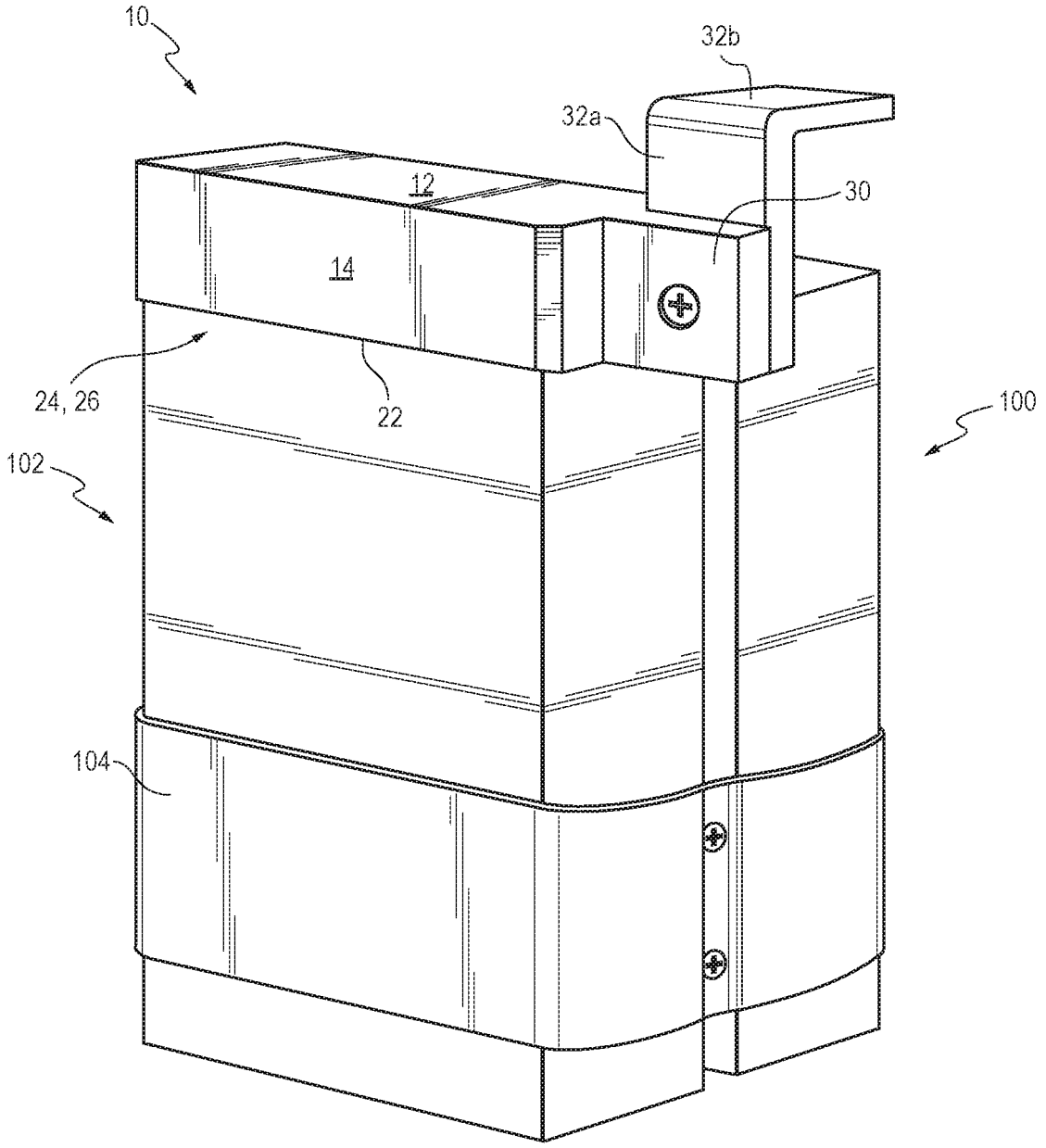
FIG. 7 is a perspective view of a cover for an ammunition magazine illustrating the cover in use with coupled ammunition magazines in accordance with one embodiment of the present invention.
Figure 8:
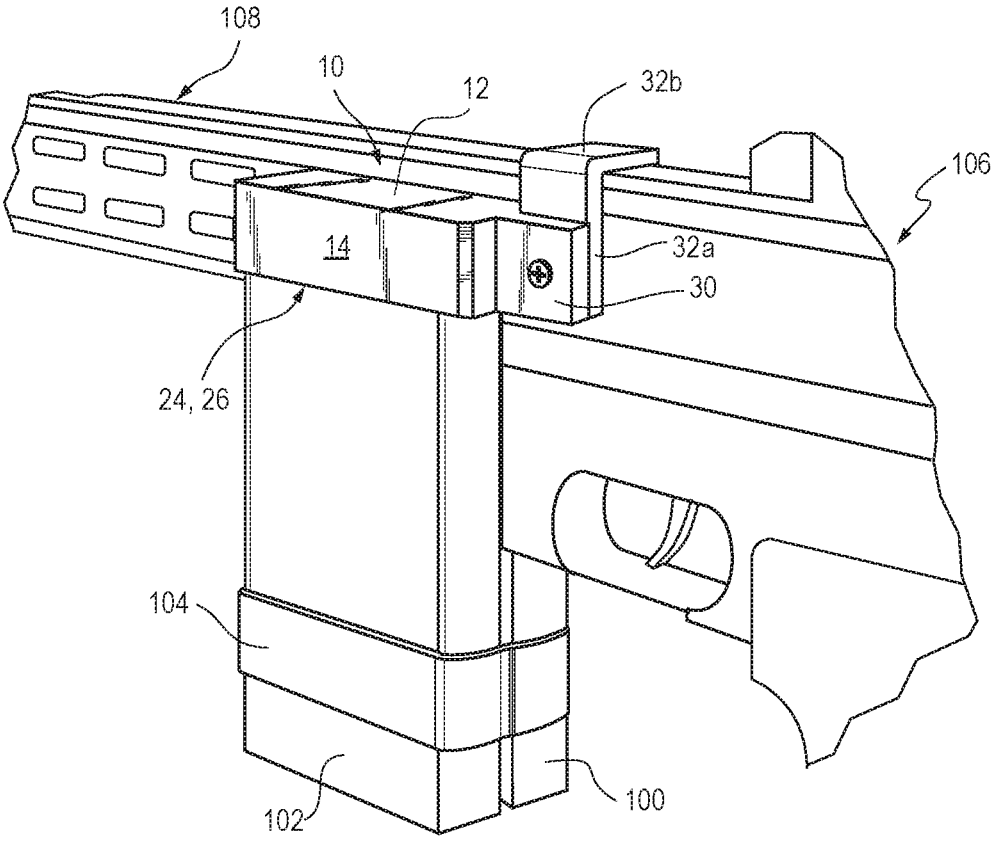
FIG. 8 is a perspective view of a cover for an ammunition magazine illustrating the cover in use with an ammunition magazine and firearm in accordance with one embodiment of the present invention.

The present invention is directed to a magazine cover 10 that can be configured for use with an ammunition magazine 100/102 and/or a firearm 106 (see FIGS. 7-8). As described herein, cover 10 can be configured for placement on the end of a magazine 100/102 in order to protect magazine 100/102 and limit or prevent debris from entering the open end of the magazine 100/102. Cover 10 can also restrict the first cartridge in an ammunition magazine from moving forward when not in use in order to limit potential malfunctions due to magazine during use with a firearm 106. As described in greater detail below, according to one embodiment of the present invention cover 10 can be configured to be used on a spare magazine 102 that is coupled to a primary magazine 100 during use with a firearm 106. As further described below, cover 10 according to one embodiment of the present invention can be configured to automatically self-eject from magazine 102 when a user of firearm 106 chooses to reload firearm 106.

Figure 2:
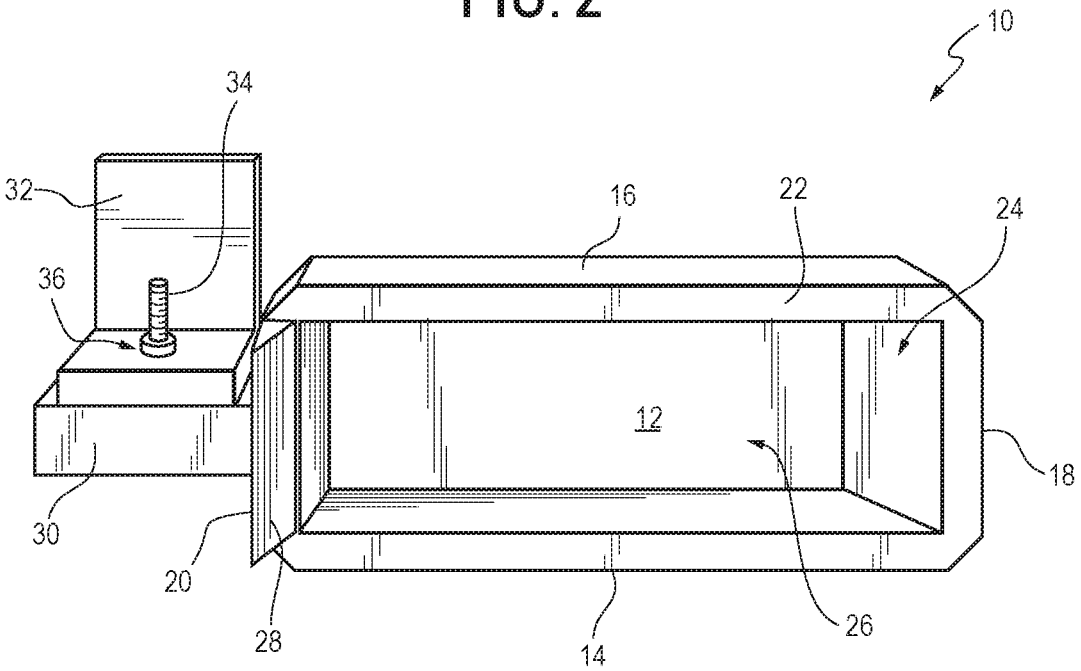
FIG. 2 is a bottom plan view of the cover of FIG. 1.

Turning to FIGS. 1 and 2, magazine cover 10 is shown according to one embodiment of the present invention. As shown, cover 10 can be defined by a main body portion that can include a top wall 12 and a perimeter sidewall extending downwardly from the edges of top wall 12. As shown in FIGS. 1 and 2, the perimeter sidewall can be formed by a plurality of side walls, including a left side wall 14, a right side wall 16, a front side wall 18 and a rear side wall 20. Each side wall 14-20 can extend downward from top wall 12 and terminate at a lower perimeter edge 22 of the perimeter sidewall and can define a cover opening 24 within the interior of cover 10. As best shown in FIG. 2, top wall 12 and side walls 14-20 can define a cavity 26 accessible through cover opening 24.

Cover opening 24 and cavity 26 can be configured to generally conform to the shape and configuration of the open end of an ammunition magazine 100/102. In such a configuration, the interior of side walls 14-20 can be configured to engage the corresponding exterior sides of the end of a magazine 100/102 so that the dimensional configuration of the interior cavity 26 is approximately equal to or similar to the dimensional configuration of the outer portion of magazine 100/102. As described in greater detail below, this can enable cover 10 to engage the end of magazine 100/102 and remain in place by means of friction until an appropriate disengaging force is applied.

For merely exemplary purposes, according to one particular embodiment, cover 10 can be constructed with the following interior dimensions in order to fit the outer dimensions of one type of standard magazine 100/102: side walls 14-20 can have an interior height of approximately 0.9 inches extending downward from top wall 12 and terminating at perimeter edge 22; side walls 14-20 can have a thickness of approximately 0.15 inches; the distance between the interior surfaces of left side wall 14 and right side wall 16 can be approximately 0.9 inches; and the distance between the interior surfaces of front side wall 18 and rear side wall 20 can be approximately 2.52 inches. The foregoing dimensional configuration is intended to illustrate only one potential dimensional configuration for cover 10 designed to fit a particular type of ammunition magazine 100/102, and it is understood that any number of different dimensional configurations of cover 10 configured for different types of magazines 100/102 are considered within the scope of the present invention. For example, one embodiment of cover 10 can be sized and configured for use with an MP5 magazine, while another embodiment can be sized and configured for use with an AR 15 magazine. Other embodiments can be configured for one or more of UMP 40 magazines, UMP 45 magazines or any other type of magazine.

As further shown in FIGS. 1 and 2, according to one embodiment, cover 10 can include a feed lip edge 28 provided on perimeter edge 22 of rear side wall 20 that can facilitate the insertion of an end of a magazine 100/102 through cavity opening 24 and into cavity 26. Feed lip edge 28 can also be provided on any portion of lower perimeter edge 22 of the perimeter sidewall including any of the other side walls 14-18. As shown FIGS. 1 and 2, according to one embodiment, feed lip edge 28 can extend downward from the edge 22 of rear side wall 18 with an angled slope extending away from cavity 26 and narrowing in thickness. As shown in FIGS. 1 and 2, feed lip edge 28 can extend at an angle of approximately 45 degrees relative to perimeter edge 22. In alternative embodiments, feed lip edge 28 can extend at an angle anywhere between 0-90 degrees. Feed lip edge 28 can be configured to create a sloped surface that helps in guiding the end of magazine 100/102 into cavity 26. As described in greater detail below, in alternative embodiments, feed lip edge 28 can be defined into lower perimeter edge 22 so that it remains generally aligned with and terminates with lower perimeter edge 22.

Figure 3:
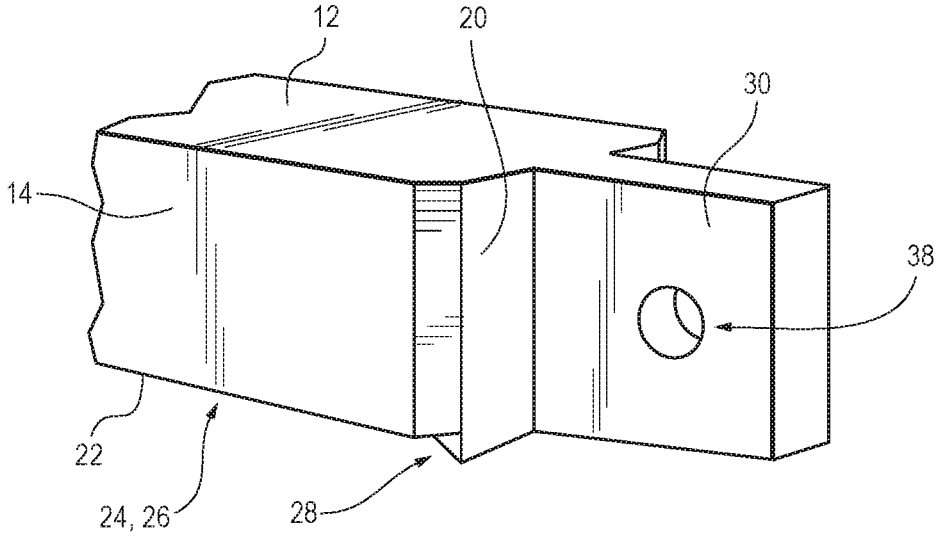
FIG. 3 is a partial perspective view of the cover of FIG. 1 illustrating a bracket mounting wing in accordance with one embodiment of the present invention.
Figure 4:
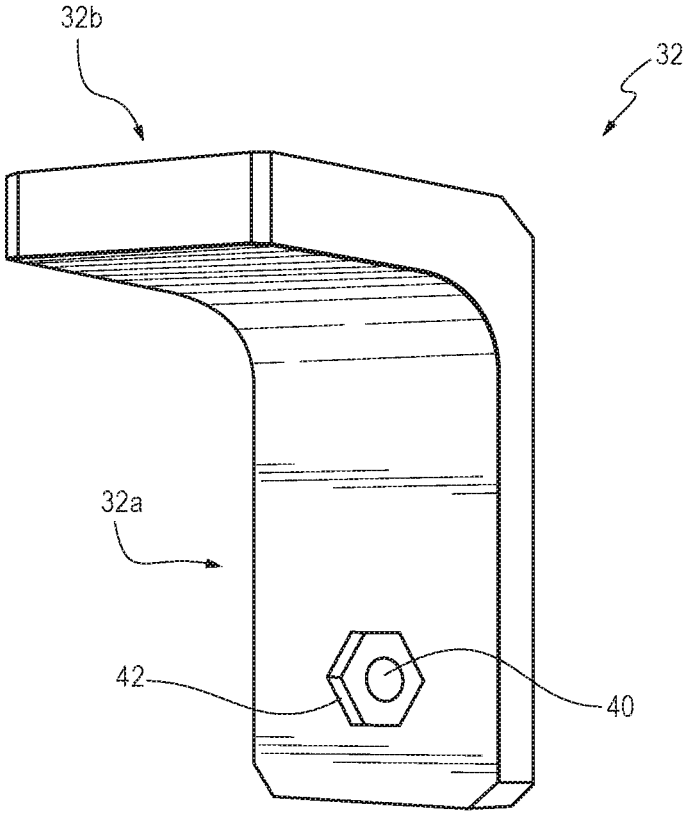
FIG. 4 is a perspective view of a bracket portion of the cover of FIG. 1 in accordance with one embodiment of the present invention.

As best shown in FIGS. 3-4, according to one embodiment, cover 10 can include a bracket portion extending from the main body portion of cover 10. The bracket portion of cover 10 can include a bracket mounting wing 30 extending laterally away from rear side wall 20 (see FIG. 3) and a bracket 32 connected to bracket mounting wing 30 (see FIG. 4). FIGS. 1-2 illustrate cover 10 with bracket 32 connected to bracket mounting wing 30. As shown in FIG. 3, bracket mounting wing 30 can extend away from approximately the center of rear side wall 20 in a generally perpendicular manner relative to the rest of cover 10 and along the longitudinal axis of cover 10. As illustrated in FIGS. 3 and 4, bracket mounting wing 30 can be configured to connect bracket 32 to the main body portion of cover 10. According to one particular embodiment, bracket mounting wing 30 can have a length of approximately 0.8 inches extending away from rear side wall 20 and a width of approximately 0.3 inches; however, it is recognized that bracket mounting wing 30 can have any suitable dimensional configuration depending on the particular embodiment and application of cover 10.

As best shown in FIG. 4, bracket 32 can be configured in a general "L" type shape with a vertical portion 32*a* that connects to bracket mounting wing 30 and a horizontal portion 32*b* that can be configured to engage with a portion of a firearm 106 when cover 10 is in use as described in greater detail below. According to one particular embodiment, the vertical portion 32*a* of bracket 32 can have a height of approximately 1.4 inches and a width of approximately 0.75 inches and the horizontal portion 32*b* of bracket 32 can have a length of approximately 1.2 inches and a width of approximately 0.75 inches, with bracket 32 having an overall thickness of approximately 0.2 inches; however, it is recognized that bracket 32 can have any suitable dimensional configuration depending on the particular embodiment and application of cover 10.

As best shown in FIGS. 1 and 2, vertical portion 32*a* of bracket 32 can be positioned adjacent to bracket mounting wing 30 and can be generally aligned with the plane of bracket mounting wing 30. As also best shown in FIGS. 1 and 2, horizontal portion 32*b* of bracket 32 can extend generally perpendicularly away from vertical portion 32*a* (and bracket mounting wing 30) and along a plane generally perpendicular to the plane defined by vertical portion 32*a* and bracket mounting wing 30. As further shown in FIGS. 1 and 2, horizontal portion 32*b* can extend laterally away from vertical portion 32*a* and cross-wise with respect to the longitudinal axis of cover 10. As described below, this arrangement of bracket 32 can enable horizontal portion 32*b* to engage an upper receiving portion 108 of a firearm 106 while the remainder of cover 10 is positioned on the side of firearm 106.

Depending on the particular embodiment of the present invention, bracket mounting wing 30 and bracket 32 can be constructed as individual components that are connected together using any suitable means (including but not limited to fasteners, screws, adhesives, welding, melting, molding, or other suitable means), or bracket mounting wing 30 and bracket 32 can be constructed as a single unitary component along with the remainder of cover 10.

As best shown in FIGS. 1-4, according to one embodiment, bracket 32 can be connected to bracket mounting wing 30 by means of a fastener 34 in the form of a machine screw 34 and nut 36 that extends through an opening 38 defined through the approximate center of bracket mounting wing 30 (see FIG. 3) and an opening 40 defined through bracket 32. As further shown in FIG. 4, according to one embodiment, bracket 32 can include an indentation 42 defined into the surface of the vertical portion 32*a* of bracket 32 that can generally conform to the shape of machine screw nut 36 and enable screw nut 36 to fit flush or recessed relative to the surface of bracket 32. According to one particular embodiment, bracket machine screw opening 40 can be located on the vertical portion 32*b* of bracket 32 and located approximately 0.45 inches from the lower edge of vertical portion 32 and approximately 0.375 inches from the side edge of vertical portion 32*b* of bracket 32. In addition, according to one embodiment, indentation 42 can be recessed relative to bracket surface approximately 0.05 inches. It is further recognized that these dimensional configurations for exemplary purposes only and several other dimensional arrangements are considered within the scope of the present invention.

Figure 5:
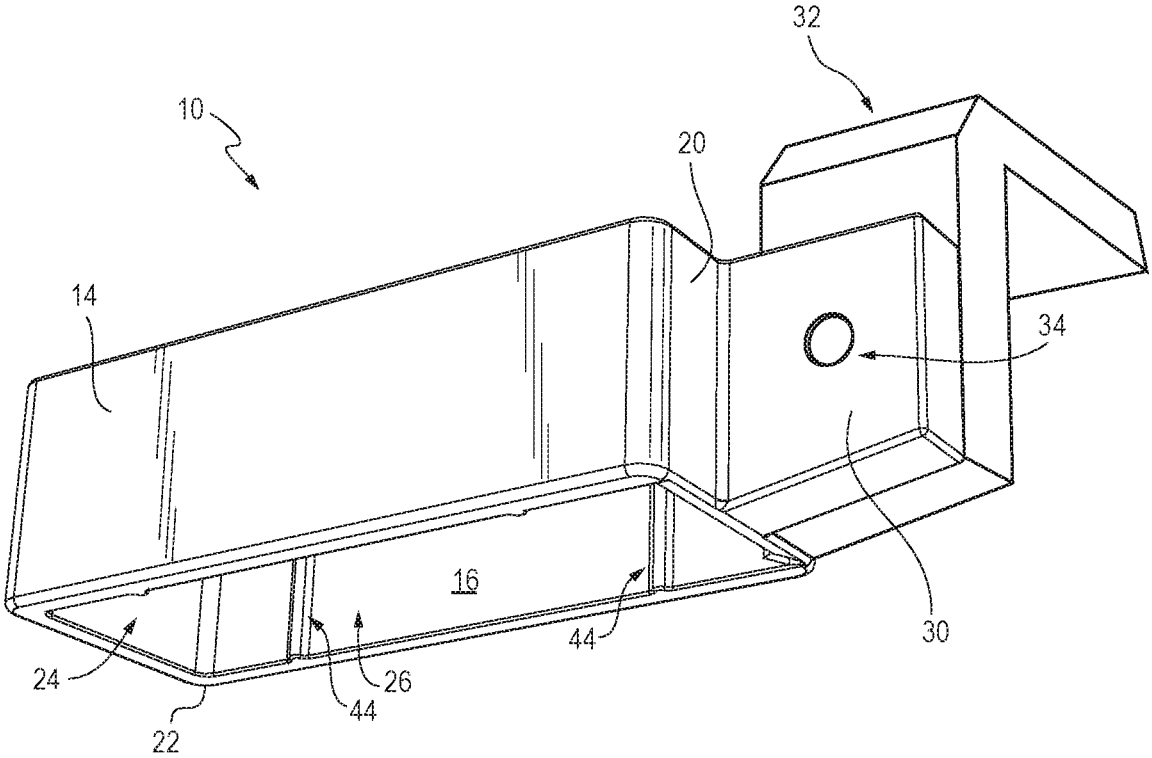
FIG. 5 is a perspective view of a cover for an ammunition magazine in accordance with another embodiment of the present invention.
Figure 6:
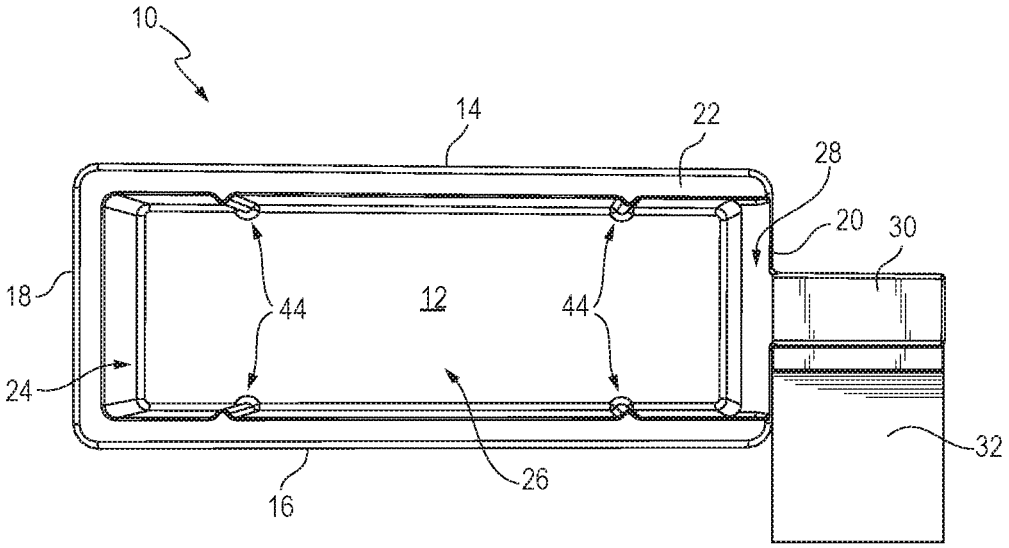
FIG. 6 is a bottom plan view of the cover of FIG. 5.

According to another embodiment of the present invention as illustrated in FIGS. 5 and 6, bracket mounting wing 30 and bracket 32 can be connected together by means of a threaded fastener insert 34 molded into bracket 32. In other embodiments of the present invention bracket 32 can be connected to bracket mounting wing 30 by any other suitable means. Further, as described above, bracket 32 and bracket mounting wing 30 can be constructed as a single unitary component integral with one another and/or integral with the remainder of cover 10.

FIGS. 5-6 illustrate another embodiment of cover 10 showing additional features that can be incorporated into cover 10. As shown in FIGS. 5-6, according to one embodiment, cover 10 can include interior protrusions 44 defined along the height of the interior surfaces of the perimeter sidewall created by side walls 14-20 within cavity 26. These interior protrusions 44 can create a conforming fit with the top end of a magazine 100/102 and enable the detachment and ejection of cover 10 from magazine 100/102 during a reload as described in greater detail below. FIGS. 5-6 illustrate protrusions 44 as elongated linear protrusions; however, protrusions 44 can have any other desired shape or configuration (such as but not limited to beads, squares, rings, waves, rectangles or other shape) in alternative embodiments of the present invention. As also shown in FIGS. 5-6, according to one embodiment, fee lip edge 28 can comprise an angled edge that is defined into perimeter edge 22 of rear side wall 20 rather than extending away from and below perimeter edge 22 as illustrated in FIG. 1.

Cover 10 can be constructed from any suitable material(s) using any suitable method depending on the desired application and particular embodiment of the present invention. For example, cover 10 can be constructed using 3D printing technology, through injection molding processes, by molding, milling, resin casting or other suitable manufacturing method. In addition, cover 10 can be constructed from any suitable material, including but not limited to, reinforced polymer, other plastics, metal, wood or other suitable material.

Turning now to FIGS. 7 and 8, cover 10 along with its operation in connection with one or more ammunition magazines 100/102 and a firearm 106 will be described in greater detail. FIGS. 7 and 8 illustrate two ammunition magazines 100 and 102 connected together using a magazine coupler 104 or other suitable means of attachment. Spare magazine 102 can be held in place relative to primary magazine 100 by coupler 104 and can be oriented vertically next to primary magazine 100. As shown in FIG. 8, the first or primary magazine 100 can be inserted into and/or positioned in the magazine well of the firearm 106 and the second or spare magazine 102 can be positioned to the side of primary magazine 100. As further shown in FIG. 8, in such a position, spare magazine 102 is positioned along the side of and laterally adjacent to the upper receiver portion 108 of firearm 106.

Once primary magazine 100 is inserted into the magazine well of firearm 106, then cover 10 can be placed over the open upper end of spare magazine 102. As described above, cover opening 24 defined by the perimeter edge 22 of the cover side walls 14-20 can be configured to approximately conform to the outer shape of the open end top of magazine 102 so that cover 10 can slide over the open end top of magazine 102 and the open end top can be received within the cover cavity 26. According to one embodiment, the dimensions of cover cavity 26 (and side walls 14-20) can be configured to be slightly less than the dimensions of the top end of spare magazine 102 so that cover 10 is removably held in place on the top end of spare magazine 102 by friction. This friction can be a strong enough force to keep the cover 10 in place during normal wear and tear but not so great that it is too difficult for the cover 10 to separate itself from spare magazine 102 during a reload as described in greater detail below. In addition to or alternatively to, according to an certain embodiments (as illustrated in FIGS. 5 and 6), cover 10 can include interior protrusions 44 provided along the interior surface side walls 14-20 that can provide the necessary frictional force to keep cover on the top end of spare magazine 102.

As further shown in FIG. 8, when cover 10 is positioned onto the upper end of spare magazine 102, bracket 32 can extend over the upper receiver portion 108 of firearm 106. As shown, the vertical portion 32*a* of bracket 32 extends upward from bracket mounting wing 30 along the longitudinal axis of cover 10 and the horizontal portion 32*b* of bracket 32 extends laterally away from mounting wing 30 perpendicular to the longitudinal axis of cover 10 and over the upper receiving portion 108 of firearm 106.

Once the user of firearm 106 has expended the ammunition/cartridges in primary magazine 100 and/or decides to reload with spare magazine 102, the user can initiate a reload action in the same manner that the user would normally reload firearm 106 and coupled magazines 100/102. During the reload action, primary magazine 100 is removed from the magazine well of firearm 106 with a downward motion of primary magazine 100. Because spare magazine 102 is connected to primary magazine 100 (via magazine coupler 104), spare magazine 102 also moves with the same downward motion as primary magazine 100. As both magazines 100 and 102 move downward, the horizontal portion 32*b* of bracket 32 engages the upper receiving portion of firearm 106 and prevents cover 10 from continuing the same downward motion of spare magazine 102. As a result, the top end of spare magazine 102 slides away from cover 10 and cover 10 disengages and ejects from spare magazine 102 and falls away from firearm 106 without any additional interaction form the user. The user can then complete the reload action by inserting spare magazine into the magazine well of firearm 106.

Cover 10 can provide the advantage of covering the spare magazine 102 without requiring any additional time and/or maneuvers during a reload action. Cover 10 can prevent debris and other objects from entering spare magazine 102 when the primary magazine 100 is being used in firearm 106 and can also reduce malfunctions due to the first cartridge in spare magazine 102 moving forward unintentionally within spare magazine 102.

Cover 10 also does not obstruct or limit a user from conducting a reload action. As described above, cover 10 can be configured to have a cavity 26 defined by the perimeter sidewall (i.e., side walls 14-20) and configured to approximately conform to the exterior shape of a spare magazine 102 so that a frictional force maintains engagement of cover 10 onto spare magazine 102 until a routine downward movement is applied to primary magazine 100 (and the coupled spare magazine 102), which causes cover 10 to disengage spare magazine 102 due to the upper receiving means 108 of firearm 106 preventing further movement of the horizontal portion 32*b* of bracket 32 of cover 10. Spare magazine 102 is then freed from cover 10, which can fall away to the ground, and spare magazine 102 can be inserted into firearm 106 to complete the reload. As a result, fast and efficient reloads can be carried out by a user without any additional time or movements in the reloading process, which can be the difference in an armed force member, police force member or other user's survival.

Cover 10 need not be used solely in connection with coupled magazines 100/102. For example, cover 10 can be placed on a single magazine 100 (or two coupled magazines 100/102) for storage to prevent debris from entering the magazine 100/102 or damage to the magazine 100/102. In such instances, cover 10 can be easily removed by striking the horizontal portion 32*b* of bracket 32 of cover 10 against any solid object, such as the user's belt of a piece of equipment or gear.

As shown in the several figures, cover 10 can be configured and orientated so that mounting wing 30 and bracket 32 are located on the rear-end of a magazine 102 when engaged with the upper receiving region 108 of a firearm 106. However, cover 10 can alternatively be configured and orientated in any desired manner. For example, cover 10 can be configured to have mounting wing 30 and bracket 32 located at the forward-end of a magazine 102 when engaged with a firearm 106 by reversing the direction of the horizontal portion 32*b* of bracket 32. According to one embodiment, as illustrated in FIGS. 1-4 and 7-8, bracket 32 can be connected to mounting wing 30 by means of a machine screw or other type of fastener 34 that can allow the orientation of bracket 32 to be rotated with respect to wing 30 and the remainder of cover 10 so that cover 10 can be used in a forward position or a rear position, or for a magazine located on either side of a firearm 106. While it is recognized that cover 10 should not be used on the ejection port side of firearm 106 (due to the potential blocking of brass from the exiting the chamber and resulting malfunction), such an embodiment provides the ability to alter the configuration of bracket 32 so that cover 10 can be configured for use with multiple types of firearms 106, including potential left-handed firearms 106. In addition, the ability to alter the configuration of bracket 32 can allow cover 10 to engage the upper receiving portion 108 of firearm 106 at different locations and therefore provide greater flexibility with respect to placement options of other instruments (e.g., optics, sights, etc.) mounted onto firearm 106.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A magazine cover configured for use with an ammunition magazine for a firearm, said magazine cover comprising:

a top wall and one or more side walls extending downwardly therefrom;

a lower perimeter edge formed along a lower end of said one or more side walls;

a cover cavity located in an interior of said magazine cover and defined by said one or more side walls and said lower perimeter edge, said cover cavity accessible through said lower perimeter edge;

a bracket mounting wing extending outward from a first wall of said one or more side walls; and a bracket extending from said bracket mounting wing, said bracket including a lower vertical portion and an upper horizontal portion, wherein said lower vertical portion is located adjacent said bracket mounting wing and said horizontal portion extends laterally away from said lower vertical portion and said bracket mounting wing;

wherein said magazine cover is configured for receiving an open end of an ammunition magazine within said cover cavity;

wherein said magazine cover is configured for use with a spare ammunition magazine coupled to a primary ammunition magazine inserted into a firearm, wherein said magazine cover is configured to receive an open end of said spare ammunition magazine and remain engaged to said open end by a frictional interference fit; and wherein said horizontal portion of said bracket of said magazine cover contacts said firearm and causes said magazine cover to disengage from said spare ammunition magazine by overcoming said frictional interference fit and fall freely away from said firearm when said primary ammunition magazine is removed from said firearm.

2. The magazine cover of claim 1, further comprising a feed lip edge located on said lower perimeter edge, said feed lip extending angularly downward from said lower perimeter edge.

3. The magazine cover of claim 1, wherein said bracket is removably connected to said bracket mounting wing.

4. The magazine cover of claim 3, wherein said bracket is connected to said bracket mounting wing by a fastener.

5. The magazine cover of claim 1, wherein said cover is constructed as a single unitary component.

6. The magazine cover of claim 1, wherein said cover cavity has a length and a width corresponding to a length and a width of said ammunition magazine to create said frictional interference fit when said open end of said ammunition magazine is inserted within said cover cavity.

7. The magazine cover of claim 1, further comprising one or more interior protrusions located on an interior surface of said one or more side walls; said interior protrusions configured for creating said frictional interference fit with said open end of said ammunition magazine when said ammunition magazine is inserted into said cover cavity.

8. A self-ejecting magazine cover configured for use on a spare ammunition magazine coupled to a primary ammunition magazine inserted into a firearm, said self-ejecting magazine cover comprising:

a top wall;

a front wall extending downward from said top wall;

a rear wall extending downward from said top wall opposite said front wall;

a first side wall extending downward from said top wall and between said top and said rear walls;

a second side wall extending downward from said top wall opposite said first side wall, wherein each of said front and rear walls and said first and second side walls have a lower edge defining a perimeter edge of said self-ejecting magazine cover;

an opening extending through said perimeter edge, wherein said opening is configured for receiving an upper end of said spare ammunition magazine and remain engaged to said upper end by a frictional interference fit;

a bracket mounting wing extending outward from said rear wall; and a bracket connected to said bracket mounting wing, wherein said bracket comprises a vertical portion extending vertically adjacent to said bracket mounting wing and a horizontal portion extending perpendicularly away from said bracket mounting wing;

wherein said horizontal portion of said bracket is configured to contact an upper receiving means of said firearm when said primary ammunition magazine is removed from said firearm;

wherein said bracket prevents said self-ejecting magazine cover from moving downward relative to said spare ammunition magazine when said horizontal portion of said bracket contacts said upper receiving means of said firearm; and wherein said self-ejecting magazine cover detaches from said spare ammunition magazine and falls from said firearm when said primary ammunition magazine is removed from said firearm as a result of said contact between said horizontal portion of said bracket and said upper receiving means of said firearm overcoming said frictional interference fit.

9. The self-ejecting magazine cover of claim 8, wherein said self-ejecting magazine cover is configured to disconnect from said upper end of said spare magazine when said primary ammunition magazine is removed from said firearm.

10. The self-ejecting magazine cover of claim 8, further comprising a feed lip edge located on said perimeter edge, wherein said feed lip edge extends at a downward angle relative to said perimeter edge.

11. The self-ejecting magazine cover of claim 10, wherein said feed lip edge is recessed into said perimeter edge.

12. The self-ejecting magazine cover of claim 8, further comprising one or more interior protrusions located on an interior surface of said first and second side walls; said interior protrusions configured for creating said frictional interference fit with said upper end of said spare ammunition magazine when said spare ammunition magazine is inserted into said opening.

13. The self-ejecting magazine cover of claim 8, wherein said bracket is removably connected to said bracket mounting wing.

14. The self-ejecting magazine cover of claim 13, wherein said bracket is connected to said bracket mounting wing by a fastener.

15. A magazine cover configured for covering an open end of an ammunition magazine, said magazine cover comprising:

a top wall;

a perimeter sidewall extending downward from said top wall and defining a cover cavity therein, said cover cavity configured for receiving said open end of said ammunition magazine;

an opening located at a lower end of said perimeter sidewall, said opening providing access to said cover cavity; and a bracket connected to said perimeter sidewall, said bracket comprising a horizontal portion extending laterally away from said perimeter sidewall;

wherein said magazine cover is configured for use with a spare ammunition magazine coupled to a primary ammunition magazine inserted into a firearm;

wherein said magazine cover is configured to receive open end of said spare ammunition magazine and remain engaged to said open end by a frictional interference fit;

wherein when said primary ammunition magazine is removed from said firearm, said horizontal portion of said bracket of said magazine cover contacts said firearm and said bracket causes said magazine cover to detach from said spare ammunition magazine due to an upward force applied to said horizontal portion of said bracket overcoming said frictional interference fit; and wherein said magazine cover falls freely away from said firearm when said magazine cover detaches from said spare ammunition magazine.

16. The magazine cover of claim 15, further comprising a bracket mounting wing extending from said perimeter sidewall and connecting said bracket to said perimeter sidewall.

17. The magazine cover of claim 15, wherein said cover is constructed as a single unitary component.

18. The magazine cover of claim 15, wherein said bracket is removably connected to said perimeter sidewall.

19. The magazine cover of claim 15, wherein at least a portion of said perimeter sidewall includes a lower edge having an angled feed lip edge.

20. The magazine cover of claim 15, wherein said perimeter sidewall includes an interior protrusion located on an interior surface of said at least one side wall, and wherein said interior protrusion extends into said cover cavity and creates said frictional interference fit with said open end of said ammunition magazine.

* * * * *